US009845234B2

(12) United States Patent
Kim

(10) Patent No.: US 9,845,234 B2
(45) **Date of Patent: *Dec. 19, 2017**

(54) REFRIGERATOR

(71) Applicant: LG Electronics Inc., Seoul (KR)

(72) Inventor: Sung-Kyoung Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 159 days.

This patent is subject to a terminal disclaimer.

(21) Appl. No.: 14/993,327

(22) Filed: Jan. 12, 2016

(65) Prior Publication Data

US 2016/0122171 A1 May 5, 2016

Related U.S. Application Data

(63) Continuation of application No. 12/988,531, filed as application No. PCT/KR2009/000298 on Jan. 20, 2009, now Pat. No. 9,267,731.

(30) Foreign Application Priority Data

Apr. 24, 2008 (KR) ..... 10-2008-0038209

(51) Int. Cl.
*B67D 1/00* (2006.01)
*F25D 23/12* (2006.01)
(Continued)

(52) U.S. Cl.
CPC ..... *B67D 1/0042* (2013.01); *B67D 1/08* (2013.01); *F25C 5/005* (2013.01); *F25D 23/028* (2013.01); *F25D 23/126* (2013.01)

(58) Field of Classification Search
CPC ..... B67D 1/0042; B67D 1/08; F25C 5/005; F25D 23/126
See application file for complete search history.

(56) References Cited

U.S. PATENT DOCUMENTS 3,153,159 A * 10/1964 Lord ..... H02K 7/125 310/191
3,308,315 A * 3/1967 Mahon ..... H02K 7/1185 310/164
(Continued)

FOREIGN PATENT DOCUMENTS

JP 58-029342 A 2/1982
JP 60-190140 A 9/1985
(Continued)

OTHER PUBLICATIONS

International Search Report dated Sep. 9, 2009 for Application No. PCT/KR2009/000298, 2 pages.

*Primary Examiner* — Emmanuel Duke
(74) *Attorney, Agent, or Firm* — Fish & Richardson P.C.

(57) ABSTRACT

Provided is a refrigerator including a main body providing a storage, a dispenser provided to the main body and configured to dispense water or ice, an operable operation part provided to the dispenser, and a dispenser motor driven according to operating the operation part, wherein the dispenser motor includes, a stator generating a magnetic field, a rotator rotatable by the magnetic field, and a compression member applying a frictional force to the rotator while rotation of the rotator is stopped. The dispensing of water or ice is quickly stopped by stopping the operating of the operation part.

20 Claims, 6 Drawing Sheets

(51) Int. Cl.

| | |
|---|---|
| ***B67D 1/08*** | (2006.01) |
| ***F25D 23/02*** | (2006.01) |
| ***F25C 5/00*** | (2006.01) |

(56) References Cited

U.S. PATENT DOCUMENTS

| | | | | |
|---|---|---|---|---|
| 3,537,618 | A | 11/1970 | Alvarez | |
| 3,601,145 | A | 8/1971 | Eyman | |
| 4,818,911 | A | 4/1989 | Taguchi | |
| 5,037,004 | A | 8/1991 | Katz | |
| 6,742,351 | B2 | 6/2004 | Kim | |
| 8,201,478 | B2 * | 6/2012 | Ramirez, Jr. ..... | F16H 57/039 74/416 |
| 2004/0070297 | A1 | 4/2004 | Yoon | |
| 2004/0083753 | A1 | 5/2004 | Kim | |
| 2005/0072167 | A1 | 4/2005 | Oh | |
| 2006/0207282 | A1 | 9/2006 | Visin | |
| 2006/0213213 | A1 | 9/2006 | Chung | |
| 2012/0304680 | A1 * | 12/2012 | Oh ..... | F25C 5/005 62/320 |

FOREIGN PATENT DOCUMENTS

| | | | |
|---|---|---|---|
| JP | 05-306858 | A | 11/1993 |
| JP | 08-075329 | A | 3/1996 |
| JP | 11-193978 | A | 7/1999 |
| JP | 2004-150785 | | 5/2004 |

* cited by examiner

[Fig. 1]
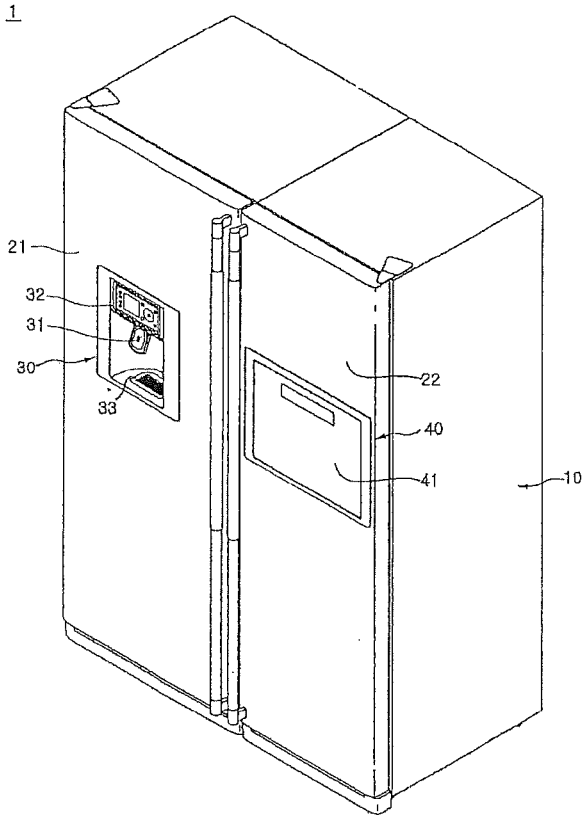
[Fig. 2]
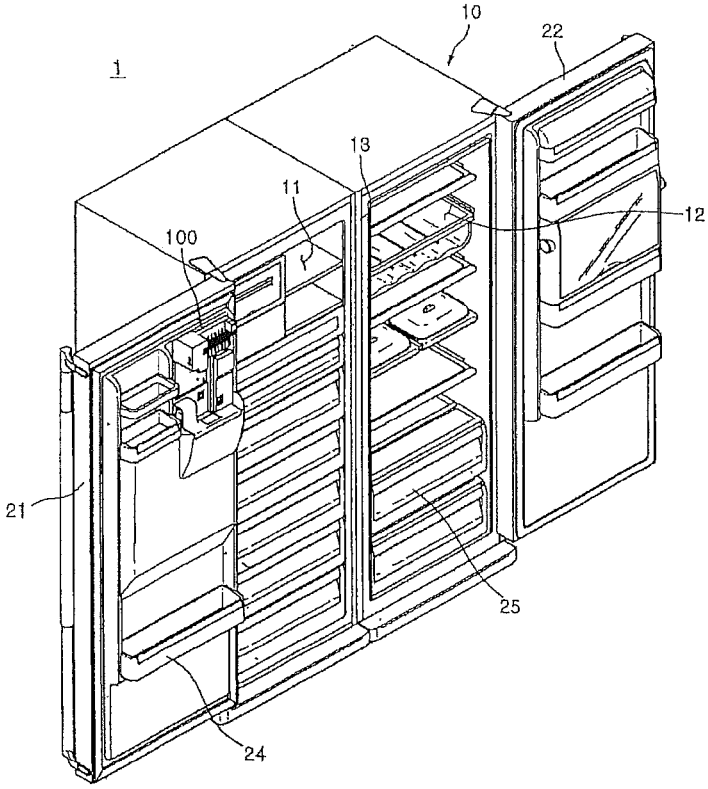

[Fig. 4]

[Fig. 6]
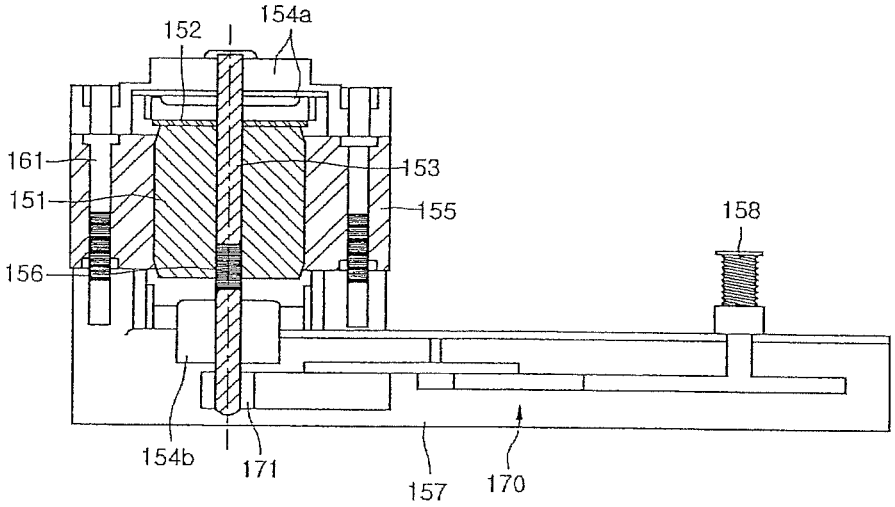
[Fig. 7]
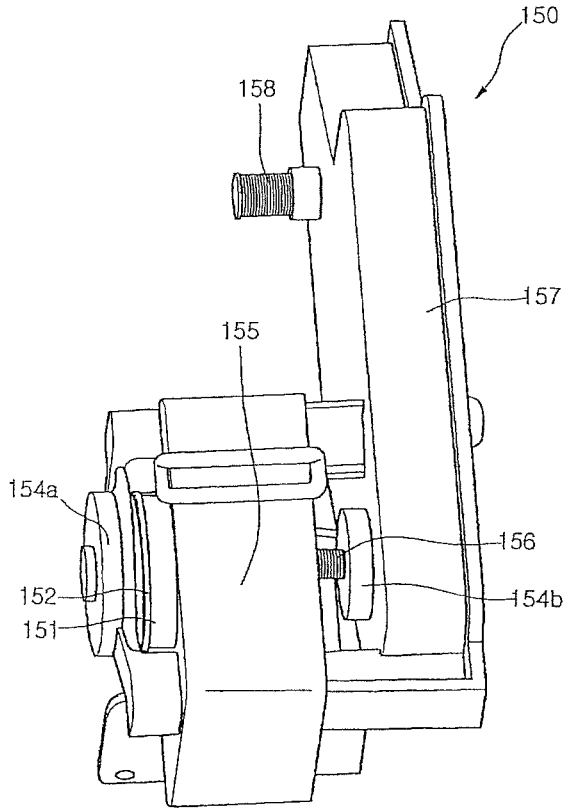

[Fig. 8]
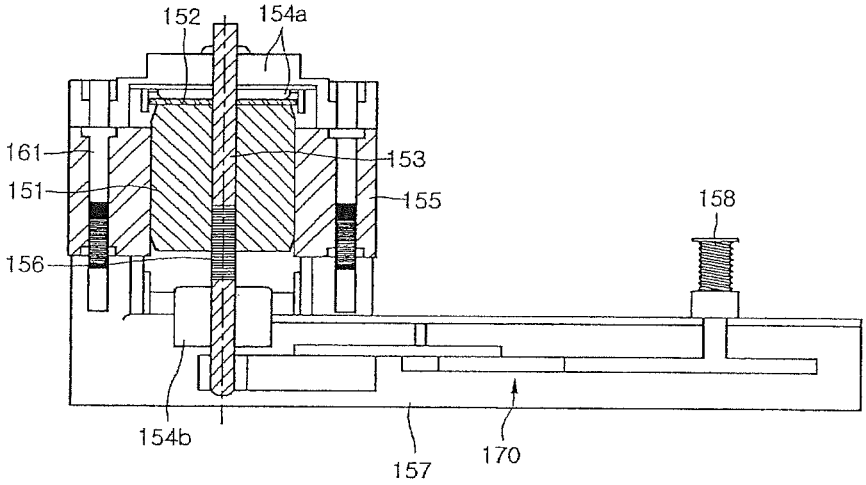

REFRIGERATOR

CROSS-REFERENCE TO RELATED APPLICATIONS

This application is a continuation of U.S. application Ser. No. 12/988,531, filed Oct. 19, 2010, which is a 371 of International Application No. PCT/KR2009/000298, filed Jan. 20, 2009, which claims the benefit of a foreign priority application filed in Korea as Serial No. 10-2008-0038209 on Apr. 24, 2008, all of which are incorporated by reference.

TECHNICAL FIELD

The present disclosure relates to a refrigerator.

BACKGROUND ART

Refrigerators are electric home appliances, which maintain their inner space at lower temperature than outside temperature to store foods at low temperature close to or below zero degrees Celsius for a long time.

Such a refrigerator includes a freezer compartment and a refrigerator compartment.

Various foods requiring refrigeration are stored in the refrigerator compartment. When the refrigerator door is opened to take out foods in the refrigerator compartment, chilly air may be discharged to the outside and high temperature outside air may be introduced into the refrigerator.

To address this issue, a refrigerator is recently developed and produced in which a front surface of a refrigerator door is provided with a dispenser to dispense water stored in a refrigerator compartment to the outside without using the refrigerator door. Also, water or ice can be conveniently taken out through the dispenser.

The dispenser is generally provided with an operation part operated by a user, that is, with a push lever. Ice can be dispensed by pushing the push lever.

The ice may be dispensed from an ice bank to the outside through a discharge part of the dispenser.

The dispenser may also be provided with a motor electrically or mechanically connected to the push lever and providing torque so that ice can be dispensed by operation of the push lever.

However, while the operation of the push lever is stopped, the motor tends to further rotate before stopping because of its moment of inertia and residual magnetic flux.

In this case, even after the push lever is stopped, ice is further dispensed for a predetermined time, so that the ice falls out of a cup.

Therefore, a user feels inconvenient in using the dispenser, and reliability of a product is reduced.

DISCLOSURE OF INVENTION

Technical Problem

Embodiments provide a refrigerator configured to minimize the residual rotation of a motor after operation of a dispenser lever is stopped by improving the structure of a dispenser of the refrigerator.

Embodiments also provide a refrigerator configured to minimize the residual rotation of a motor by providing a compression member having a simple structure to a dispenser.

Embodiments also provide a refrigerator configured to stop dispensing water or ice simultaneously with stopping a dispenser.

Technical Solution

In one embodiment, a refrigerator includes: a main body providing a storage; a dispenser provided to the main body and configured to dispense water or ice; an operable operation part provided to the dispenser; and a dispenser motor driven according to operating the operation part, wherein the dispenser motor includes: a stator generating a magnetic field; a rotator rotatable by the magnetic field; and a compression member applying a frictional force to the rotator while rotation of the rotator is stopped.

In another embodiment, a refrigerator includes: an ice-making device provided with an ice bank adapted for storing ice; and a dispenser motor providing a driving force to dispense the ice from the ice bank, wherein the dispenser motor includes: a stator generating a magnetic field; a rotator rotatable by the magnetic field and closely contacting a side of the dispenser motor while rotation of the rotator is stopped; and an elastic member provided to a side of the rotator and moving the rotator in a direction while the rotation of the rotator is stopped.

In further another embodiment, a refrigerator includes: an ice bank configured to store ice; a dispenser provided to a side of the ice bank and configured to dispense the ice of the ice bank; an operation part provided to the dispenser and operable to dispense the ice; and a dispenser motor driven by operating the operation part, wherein the dispenser motor includes: a stator generating a magnetic field; a rotator provided to a side of the stator and movable in a direction; an elastic member applying a restoring force to the rotator; and a compression member closely contacting the rotator while the rotator stops.

The details of one or more embodiments are set forth in the accompanying drawings and the description below. Other features will be apparent from the description and drawings, and from the claims.

Advantageous Effects

According to the embodiments, the dispenser of the refrigerator is provided with the elastic member coupled to the rotation shaft of the motor, and the rotator of the motor is easily moved to the stop position by the restoring force of the elastic member.

Also, one side of the rotator is provided with the compression member reducing the torque of the rotator, and the rotator is quickly stopped by the frictional force due to the compression member.

Also, when the operating of the dispenser lever is finished, the rotation of the rotator is quickly stopped, so as to prevent water or ice from being further dispensed.

Also, an accurate amount of water or ice is dispensed by a user's operation, so as to improve convenience in use and reliability of a product.

BRIEF DESCRIPTION OF THE DRAWINGS

FIG. 1 is a perspective view illustrating a refrigerator including a dispenser according to an embodiment.

FIG. 2 is a perspective view illustrating an inner side of a refrigerator door with a dispenser according to an embodiment.

FIG. 6 is a cross-sectional view taken along line I-I' of FIG. 4.

FIG. 7 is a perspective view illustrating a state where a dispenser motor is stopped according to an embodiment.

FIG. 8 is a cross-sectional view illustrating a state where a dispenser motor is stopped according to an embodiment.

MODE FOR THE INVENTION

Reference will now be made in detail to the embodiments of the present disclosure, examples of which are illustrated in the accompanying drawings.

Figure 3:
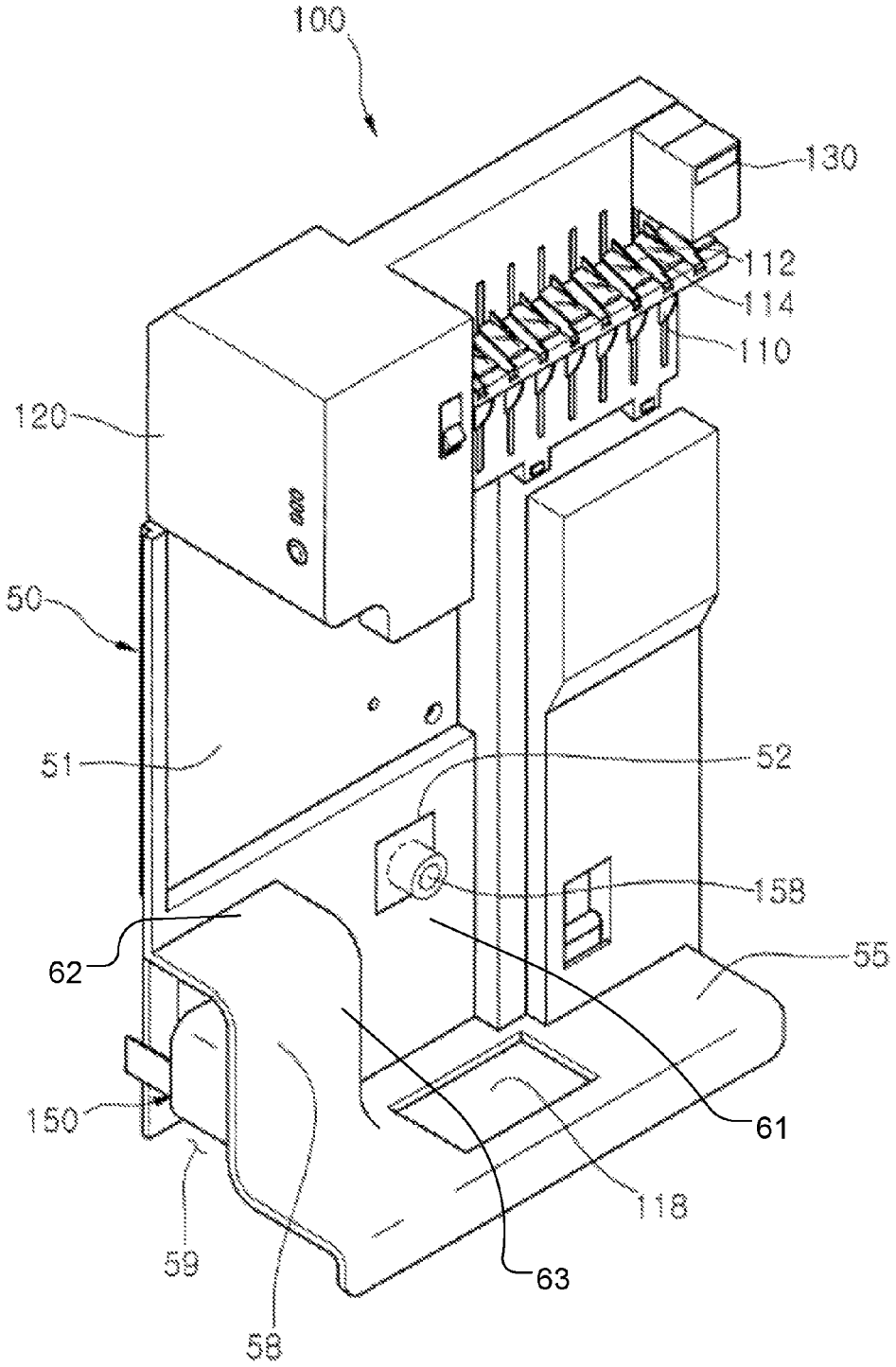
FIG. 3 is a perspective view illustrating configuration of an ice-making device according to an embodiment.

FIG. 1 is a perspective view illustrating a refrigerator including a dispenser according to an embodiment. FIG. 2 is a perspective view illustrating an inner side of a refrigerator door with a dispenser according to an embodiment. FIG. 3 is a perspective view illustrating configuration of an ice-making device according to an embodiment.

Referring to FIGS. 1 to 3, a refrigerator 1 according to the embodiments includes a main body 10 storing chilly air, a freezer compartment door 21, and a refrigerator compartment door 22. The freezer compartment door 21 and the refrigerator compartment door 22 are rotatably provided to a front surface of the main body 10 and selectively open and close a freezer compartment 11 and a refrigerator compartment 12, respectively.

The main body 10 is provided with the freezer compartment 11 and the refrigerator compartment 12, and the freezer compartment 11 and the refrigerator compartment 12 may be separated by a separation part 13.

Hereinafter, a side-by-side-type refrigerator, including a freezer compartment and a refrigerator compartment at left and right sides, will be exemplified. However, positions of a freezer compartment and a refrigerator compartment are not limited thereto, and a top-mount-type refrigerator in which a freezer compartment is disposed on a refrigerator compartment, or a bottom freezer-type refrigerator in which a freezer compartment is disposed under a refrigerator compartment may be provided according to other embodiments.

Particularly, the main body 10 is provided with a plurality of drawable storage 25 that may store an object.

The freezer compartment door 21 and the refrigerator compartment door 22 may be provided with a plurality of baskets 24 storing an object.

Particularly, the refrigerator compartment door 22 is provided with a home bar 40 allowing access to foods without opening the refrigerator compartment door 22. The home bar 40 includes a home bar door 41. Since the home bar door 41 selectively opens the home bar 40, the discharge of chilly air is minimized.

Also, the freezer compartment door 21 is provided with a dispenser 30 to dispense drinking water. The dispenser 30 is concaved reward from the freezer compartment door 21, and a lower portion of the dispenser 30 may be provided with a cup for receiving supplied water.

Particularly, the dispenser 30 includes an operation part 31 operated to dispense water from the dispenser 30, and a drain container 33 configured to collect water discarded to the outside during operation of the dispenser 30.

The operation part 31 is provided in a dispenser lever shape, and movable in a back-and-forth direction. When the operation part 31 is pressed, water or ice is dispensed.

When the pressing of the operation part 31 is stopped, the dispensing of the water or ice is stopped.

The drain container 33 is provided to the lower portion of the dispenser 30, and is removably coupled to the freezer compartment door 21.

A display part 32 configured to display operation state of the dispenser 30 is provided to the upper portion of the dispenser 30.

The dispenser 30 may be coupled to an inner surface of the freezer compartment door 21. That is, an opening having penetrated front and rear portions may be provided to a portion of the freezer compartment door 21 to which the dispenser 30 is coupled, and the dispenser 30 may be coupled to the opening.

An ice-making device 100 configured to provide ice to the dispenser 30 is provided to the upper side of the dispenser 30. The ice-making device 100 may be provided to the inner surface of the freezer compartment door 21.

The ice-making device 100 includes a water supply part 130 configured to receive water supplied from the outside, an ice tray 110 configured to store water supplied from the water supply part 130 and receiving chilly air to make ice, an ejector 112 guiding ice made at the ice tray 110 to be removed from the ice tray 110 to an ice bank (not shown), and a guide surface 114 efficiently guiding ice removed by the ejector 112 to the ice bank.

The ice bank provides a space for storing ice made at the ice tray 110 and may be provided to the lower side of the ice tray 110.

The ice-making device 100 may be provided with a motor (not shown) providing a driving force for rotating the ejector 112. The motor is disposed in a motor housing 120.

A side of the ice-making device 100 is provided with a dispenser motor 150 connected to the ice bank and providing a torque for discharging ice from the ice bank to the dispenser 30.

The dispenser motor 150 includes a rotation connection part 158 connected to the ice bank and rotating an auger (not shown) of the ice bank. The auger is rotatably provided to the ice bank to guide ice to be dispensed to the outside, detailed description of which is omitted.

Although not shown, the ice bank is disposed on a front side of the rotation connection part 158, as illustrated in FIG. 3.

The lower side of the rotation connection part 158 is provided with an ice dispenser part 118 where ice discharged from the ice bank falls. The ice dispenser part 118 has an open hole shape and may be disposed on the upper side of the operation part 31. The ice dispenser part 118 is located in a housing 119 that includes a first portion **119*a* and a second portion 119*b*. Located behind the second portion 119*b* of the housing 119 is a rotation shaft 153 of the dispenser motor 150. The relative distances between a plane defined by the first portion 119*a* of the housing 119 and the rotation connection part 158 and between the plane and the rotation shaft 153 are described below and illustrated in FIGS. 4-8**.

The ice-making device 100 includes a plate 55. The plate 55 defines the ice dispenser part 118. The plate 55 includes a vertical portion 61 that defines a through hole 52 that is configured to receive the rotation connection part 158. The plate 55 include a motor accommodation portion 58 that protrudes from a lower portion of the plate 55 and that defines a space 59 for the dispenser motor 150. The motor accommodation portion 58 includes a first part 62 that extends horizontally from the vertical portion 61 and a second part 63 that extends down. The second part 63 of the motor accommodation portion 58 connects to the bottom of the plate 55 where the ice dispenser part 118 is located.

Figure 4:
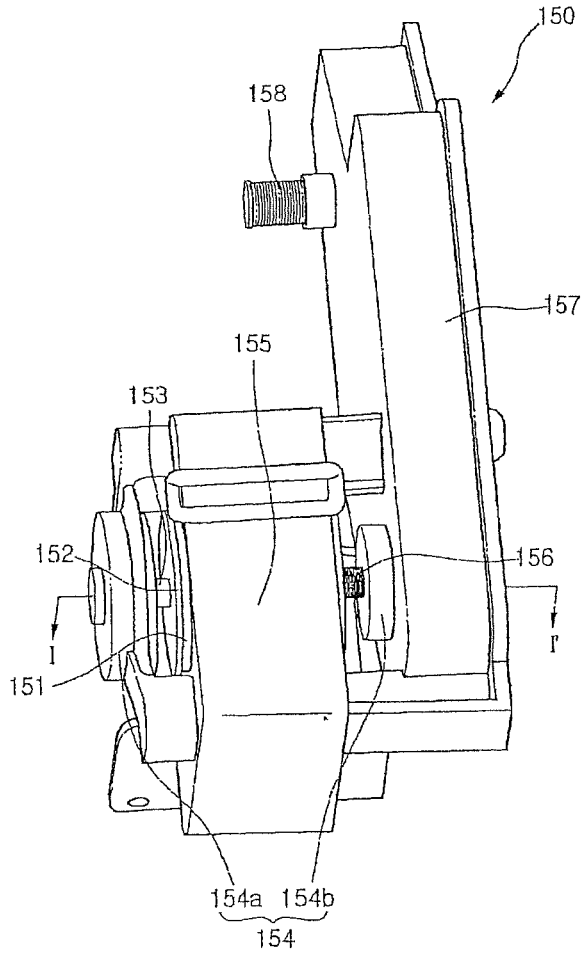
FIG. 4 is a perspective view illustrating a state where a dispenser motor rotates according to an embodiment.
Figure 5:
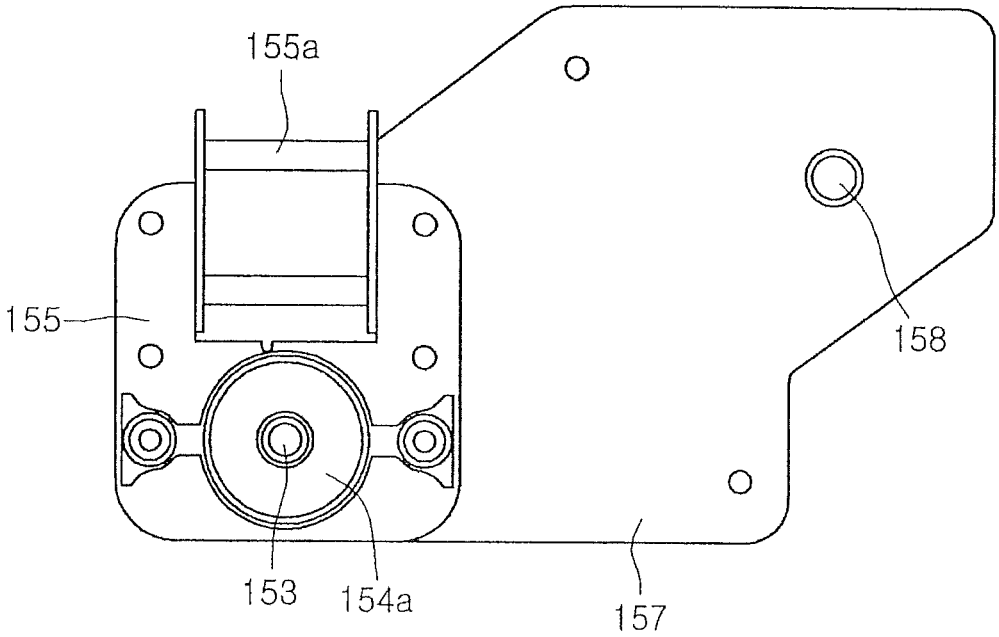
FIG. 5 is a side view illustrating configuration of a dispenser motor according to an embodiment.

FIG. 4 is a perspective view illustrating a state where a dispenser motor rotates according to an embodiment. FIG. 5 is a side view illustrating configuration of a dispenser motor according to an embodiment. FIG. 6 is a cross-sectional view taken along line I-I' of FIG. 4.

Referring to FIGS. 4 to 6, the dispenser motor 150 includes a stator 155 forming a rotating magnetic field, a rotator 151 disposed in the stator 155 and receiving a torque according to polarity of the stator 155, and a coil 155*a* supplying a current to form a magnetic field at the stator 155.

Particularly, the rotator 151 has a cylindrical shape, and may include a permanent magnet receiving a torque according to polarity of the stator 155.

The stator 155 surrounds an outer surface of the rotator 151, and polarity of a magnet is changed by an alternating current supplied to the coil 155*a*.

The coil 155*a* may be disposed on one side of the stator 155. Power may be applied to the coil 155*a* by operating the operation part 31.

The rotator 151 is provided with a rotation shaft 153 rotating around a fixed axis 153*c* and integrally with the rotator 151. The rotation shaft 153 passes through the center of the rotator 151 and extends toward both sides thereof.

Both sides of the rotation shaft 153 are provided with a shaft housing 154 in which the rotation shaft 153 is movably received. The shaft housing 154 includes a first shaft housing 154*a* provided to first shaft portion 153*a* and a second shaft housing 154*b* provided to a second shaft portion 153*b*.

The first shaft housing 154*a* is coupled to one side of the stator 155, and a coupling member 161 such as a screw may be employed.

A compression member 152 is interposed between the first shaft housing 154*a* and the rotator 151 and provides a predetermined frictional force to stop rotation of the rotator 151. For example, the compression member 152 may include cork. The compression member 152 also defines a through part 152*a* that is located in the middle of the compression member 152 and that is configured to receive the first shaft portion 153*a*.

One side surface of the compression member 152 corresponds to one side surface of the rotator 151, in shape and size. The compression member 152 may be in surface contact with the rotator 151 so as to provide the frictional force.

The rotator 151 and the compression member 152 may be in close contact with a surface 154*c* of the first shaft housing 154*a* while the rotator 151 stops. Hereinafter, a position, where the rotator 151 and the compression member 152 are in close contact with the surface 154*c* of the first shaft housing 154*a*, is referred to as a "stop position".

The rotation shaft 153 is provided with an elastic member 156 to move the rotator 151 to the stop position while the rotator 151 stops.

As illustrated in FIG. 6, at least one portion of the elastic member 156 may be received in the rotator 151. One side of the elastic member 156 may be connected to the rotator 151 so as to move the rotator 151.

That is, the elastic member 156 moves the rotator 151 using a self-restoring force.

For example, the elastic member 156 may include a coil spring provided to the outer surface of the rotation shaft 153. The coil spring may be a compression spring generating a restoring force in the opposite direction to a tensile direction.

One side of the second shaft housing 154*b* may be provided with a gear assembly 170 transmitting the torque of the rotator 151 to the rotation connection part 158. The gear assembly 170 is received in a gear housing 157.

One end of the rotation shaft 153 is provided with a shaft gear 171 that may engage with at least one gear of the gear assembly 170.

Thus, the gear assembly 170 rotates according to rotation of the rotation shaft 153, and then the rotation connection part 158 rotates according to the rotation of the gear assembly 170. Detailed description for power transmission structure of gears will be omitted.

Hereinafter, operation of a rotator and a compression member will now be described according to one embodiment.

FIGS. 4 to 6 illustrate the rotated state of the rotator 151.

When the operation part 31 is operated to apply electric power to the coil 155*a*, alternating current flows trough the coil 155*a*. Accordingly, a magnetic field is generated at the stator 155. The magnetic field has the nature of the rotating magnetic field in which polarity changes according to time, due to the nature of the alternating current.

That is, there is an effect of rotating a magnetic pole of the stator 155 in a predetermined direction.

The rotator 151 is moved to a center direction of the stator 155 by the magnetic field generated at the stator 155. That is, the rotator 151 is spaced apart from the first shaft housing 154*a* and moves to the center of the stator 155.

At this point, the moving rotator 151 overcomes the elastic force of the elastic member 156, so that the elastic member 156 is compressed.

The rotator 151 is rotated in the rotation direction of the magnetic pole by the rotating magnetic field of the stator 155, that is, by the magnetic pole rotating in the predetermined direction.

As the rotator 151 rotates, the rotation shaft 153 rotates in the rotation direction of the rotator 151, and the torque of the rotation shaft 153 is transmitted to the rotation connection part 158 by the gear assembly 170.

When the rotation connection part 158 is rotated, the auger of the ice bank operates, and ice in the ice bank is dispensed through the ice dispenser part 118 to the dispenser 30.

FIG. 7 is a perspective view illustrating a state where a dispenser motor is stopped according to an embodiment. FIG. 8 is a cross-sectional view taken along line H-H' of FIG. 7.

Referring to FIGS. 7 and 8, the operation of the dispenser motor 150 stops when the operation part 31 stops, that is, when the pushing operation on the operation part 31 is finished.

While the rotation of the dispenser motor 150 stops, the rotator 151 is in close contact with the compression member 152, so that the rotation of the rotator 151 quickly stops. That is, the rotator 151 stops quickly just when the operation part 31 stops, so as to minimize subsequent residual rotation.

Particularly, when the operation part 31 stops, the applied electric power is removed from the coil 155*a* to prevent the flow of the current. Then, the generated magnetic field is removed from the stator 155, so as to remove the torque applied to the rotator 151.

Accordingly, the force moving the rotator 151 to the center of the stator 155 is removed, and simultaneously, the restoring force of the elastic member 156 is applied to the rotator 151.

Then, the rotator 151 moves to be in close contact with the first shaft housing 154*a*. At this point, the compression member 152 is moved to the first shaft housing 154*a* by the rotator 151. That is, the rotator 151 is in close contact with the compression member 152, and the compression member 152 is in close contact with one surface of the first shaft housing 154*a*.

Thus, the frictional force is applied between the rotator 151 and the compression member 152, so that the rotator 151 is stopped.

To sum up, when the rotating magnetic field generated at the stator 155 is removed, the rotator 151 and the compression member 152 are in close contact with the first shaft housing 154*a*, so that the rotator 151 is stopped.

After that, when current is applied to the coil 155*a* again, the rotator 151 is spaced apart from the compression member 152 and moves to the center of the rotator 151. At this point, the elastic member 156 is compressed.

According to the above configuration, the rotation of the rotator 151 stops quickly when the operation part 31 stops.

Therefore, this is possible to minimize the limitation in the related art, i.e., the phenomenon in which a rotator further rotates because of its moment of inertia and residual magnetic flux after the operating of the operation part 31 is stopped.

Another embodiment is provided.

While dispensing ice is controlled through the dispenser 30 in the previous embodiments, the same configuration may be applied to a case of dispensing water instead of ice.

That is, a main body of a refrigerator is provided with a water container, and water stored in the water container is dispensed by operating an operation part. In other words, water in the water supply part 130 provided to the ice-making device 100 may be supplied directly to the dispenser 30.

When the operation part is pressed, water in the water container is dispensed. When the operating of the operation part is stopped, the rotation of the rotator quickly is stopped, so that the dispensing of water is finished.

In addition, an additional control device may be provided to dispense water or ice according to user's selection.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

In the refrigerator configured according to the above embodiments, when the operating of the operating part is finished, the dispensing of ice is quickly stopped to improve convenience in use.

The invention claimed is:

1. A refrigerator comprising:

a main body that defines a storage compartment;

a door that is configured to open and close the storage compartment;

a dispenser that is located on the door;

a plate that is mounted on an inner surface of the door, that comprises a horizontal portion that has an ice dispenser part; and a dispenser motor that is covered by the plate and that comprises:

a stator;

a rotator;

a rotation shaft that is connected to the rotator and that projects from the rotator in a first direction;

a gear assembly that is coupled to the rotation shaft, that includes a first gear that is coupled to the rotation shaft, and that includes a second gear that is configured to engage the first gear; and a connection part that is coupled to the second gear, that projects from the gear assembly in a second direction that is opposite the first direction, and that is configured to couple to an ice bank, wherein a distance between the connection part and a bottom of the dispenser motor is greater than a distance between the rotation shaft and the bottom of the dispenser motor.

2. The refrigerator according to claim 1, further comprising a gear housing that is configured to receive the first gear and the second gear.

3. The refrigerator according to claim 2, wherein:

the gear housing comprises a first bottom surface, and the bottom of the dispenser motor comprises the first bottom surface of the gear housing.

4. The refrigerator according to claim 3, wherein:

the stator comprises a second bottom surface, and the bottom of the dispenser motor comprises the second bottom surface of the stator.

5. The refrigerator according to claim 3, wherein the first bottom surface of the gear housing and the second bottom surface of the stator form a straight surface.

6. The refrigerator according to claim 1, wherein:

the first and second gears are arranged in a third direction, and the third direction is approximately perpendicular to the first or second direction.

7. The refrigerator according to claim 1, wherein the plate further comprises:

a vertical portion that extends up from the plate and that defines a through hole.

8. The refrigerator according to claim 7, wherein the connection part is configured to pass through the through hole and protrude from the vertical portion of the plate.

9. The refrigerator according to claim 7, wherein the plate further comprises:

a motor accommodation portion that protrudes from a lower portion of the plate, that defines a space that is configured to receive the dispenser motor, and that is spaced apart from the through hole.

10. The refrigerator according to claim 9, wherein the motor accommodation portion is configured to receive the stator.

11. The refrigerator according to claim 9, wherein:

the ice dispenser part is located below the connection part, and the motor accommodation portion is located laterally to the connection part.

12. The refrigerator according to claim 9, wherein the motor accommodation portion further comprises:

a first part that extends horizontally from the vertical portion; and a second part that extends down from the first part.

13. The refrigerator according to claim 12, wherein a connection between the first part of the plate and the second part of the plate is curved.

14. The refrigerator according to claim 12, wherein a distance between the through hole and the horizontal portion of the plate and a length of the second part of the plate are approximately equal.

15. The refrigerator according to claim 12, wherein the first part of the plate, the second part of the plate, and the vertical portion define the space of the motor accommodation portion.

16. The refrigerator according to claim 12, wherein the second part of the plate is connected to the horizontal portion of the plate.

17. The refrigerator according to claim 16, wherein a connection between the second part of the plate and the horizontal portion of the plate is curved.

18. The refrigerator according to claim 12, wherein a length of the first part of the plate is greater than a width of the dispenser motor.

19. The refrigerator according to claim 12, wherein a connection between the second part of the plate and the horizontal portion of plate is approximately in line with an edge of the ice dispenser part.

20. The refrigerator according to claim 7, wherein the through hole is approximately square-shaped.

* * * * *